US011575997B2

(12) United States Patent
Powell

(10) Patent No.: US 11,575,997 B2
(45) Date of Patent: Feb. 7, 2023

(54) IN-LINE FILTER USING SCALAR COILS

(71) Applicant: Soniphi LLC, Incline Village, NV (US)

(72) Inventor: Wayne J. Powell, Centennial, CO (US)

(73) Assignee: SONIPHI LLC, Incline Village, NV (US)

( * ) Notice: Subject to any disclaimer, the term of this patent is extended or adjusted under 35 U.S.C. 154(b) by 0 days.

(21) Appl. No.: 17/485,159

(22) Filed: Sep. 24, 2021

(65) Prior Publication Data

US 2022/0014856 A1 Jan. 13, 2022

Related U.S. Application Data

(63) Continuation of application No. 16/942,573, filed on Jul. 29, 2020, now abandoned, which is a continuation of application No. 16/553,653, filed on Aug. 28, 2019, now Pat. No. 10,924,868.

(60) Provisional application No. 62/724,601, filed on Aug. 29, 2018.

(51) Int. Cl.

| | |
|---|---|
| ***H04R 23/02*** | (2006.01) |
| ***H04R 1/10*** | (2006.01) |
| ***H04R 23/00*** | (2006.01) |

(52) U.S. Cl.

CPC ..... *H04R 23/02* (2013.01); *H04R 1/1016* (2013.01); *H04R 1/1075* (2013.01); *H04R 1/1091* (2013.01); *H04R 23/008* (2013.01)

(58) Field of Classification Search

CPC .... H04R 23/02; H04R 1/1016; H04R 1/1075; H04R 1/1091; H04R 23/008

USPC ..... 381/74

See application file for complete search history.

(56) References Cited

U.S. PATENT DOCUMENTS

| | | | |
|---|---|---|---|
| 512,340 | A | 1/1894 | Tesla |
| 4,379,988 | A | 4/1983 | Mattatall |
| 2008/0056521 | A1* | 3/2008 | Phillips Waldron ..... H04R 25/554 381/331 |
| 2014/0140565 | A1 | 5/2014 | Liu |
| 2015/0257662 | A1 | 9/2015 | Lee et al. |
| 2015/0264472 | A1 | 9/2015 | Aase |
| 2017/0094389 | A1 | 3/2017 | Saulsbury et al. |
| 2017/0238080 | A1 | 8/2017 | McCarthy |
| 2017/0311068 | A1 | 10/2017 | Shin |
| 2018/0146310 | A1 | 5/2018 | Bazzoni |

FOREIGN PATENT DOCUMENTS

| | | |
|---|---|---|
| CN | 206294320 | 6/2017 |
| KR | 20170039428 | 4/2017 |

OTHER PUBLICATIONS

International Search Report dated Mar. 31, 2020, from related PCT Application No. PCT/US2019/048744, filed on Aug. 29, 2019.

* cited by examiner

*Primary Examiner* — Paul Kim
(74) *Attorney, Agent, or Firm* — Fish IP Law, LLP

(57) ABSTRACT

An in-line filter uses scalar coils positioned in series with an input of a speaker to modify or enhance the audio quality and of the speaker, and its auditory effects on a user, by changing the sound signature and reducing digital noise. Scalar coils have two spiral windings with opposite winding directions. Scalar coils can also be used in series with a laser emitter that produces a laser beam that travels through the scalar coil, which produce electromagnetic forces that improve perceived audio quality in a user.

12 Claims, 8 Drawing Sheets

IN-LINE FILTER USING SCALAR COILS

This application is a continuation of, and claims priority to, U.S. application Ser. No. 16/942,573, filed on Jul. 29, 2020, which is a continuation of, and claims priority to U.S. application Ser. No. 16/553,653, filed on Aug. 28, 2019, which claims priority to U.S. Provisional Application Ser. No. 62/724,601 filed on Aug. 29, 2018. These and all other referenced extrinsic materials are incorporated herein by reference in their entirety.

FIELD OF THE INVENTION

The field of the invention is earbuds.

BACKGROUND

The following description includes information that may be useful in understanding the present invention. It is not an admission that any of the information provided herein is prior art or relevant to the presently claimed invention, or that any publication specifically or implicitly referenced is prior art.

Earbud-style headphones are popular among users because earbud headphones are generally small and portable. However, conventional earbuds and other audio devices do not incorporate advanced audio signal manipulation techniques (e.g., scalar coils) to improve the electromagnetic signal arriving at the speaker to enhance the audio quality. Moreover, conventional earbuds do not use light-based techniques (e.g., photonic boom principle) to enhance auditory effects.

Thus, there is still a need for earbuds and other audio devices to use advanced audio signal manipulation techniques to enhance their audio quality and light-based techniques to enhance auditory effects.

SUMMARY OF THE INVENTION

The inventive subject matter provides apparatus, systems and methods in which one or more scalar coils is used to modify or enhance the audio quality and of a speaker system and its auditory effects on the user. The scalar coil(s) can be implemented directly in a speaker system, or included within an in-line filter.

In some embodiments, the speaker system can include a speaker and an elongated coil coupled to the speaker. In preferred embodiments, the elongated coil is a scalar coil. As used herein, a "scalar coil" is a coil or array of coils that exhibit scalar effects. Scalar coils and scalar effects were described at least as early as 1894, in U.S. Pat. No. 512,340 to N. Tesla. Scalar coils need not be entirely flat.

One type of scalar coil comprises a single strand of coil that has at least two segments of spiral winding, where the second segment winds in an opposite direction to the first segment, when viewed from the wider end of the first segment. As used herein, "spiral winding" refers to winding in a continuous and gradually widening curve, about a center axis to form at least a partial cone. For example, a first spiral winding can be wound in a clockwise direction (when viewed from the wider end of the first spiral winding), and a second spiral winding can be wound in a counterclockwise direction (also viewed from the wider end of the first spiral winding). Alternatively, a first spiral winding can be wound in a counterclockwise direction (when viewed from the wider end of the first spiral winding), and a second spiral winding can be wound in a clockwise direction (also viewed from the wider end of the first spiral winding). In especially preferred embodiments, a first elongated coil is arranged in series with an input of the speaker, and the first spiral winding shares a center and a center axis with the second spiral winding.

Another type of scalar coil is a coil matrixed with other coils, in positions and orientations that produce scalar effects.

In some embodiments, the contemplated speaker system can include a light emitting device and an elongated coil coupled to the laser emitting device. Suitable light emitting devices include, but are not limited to, lasers, LEDs, and solid-state lasers. In preferred embodiments the light emitting device is a laser or solid-state laser. The elongated coil coupled to the light emitting device is similar or identical to the elongated coil coupled to the speaker described above. It is contemplated that the light emitting device is positioned and oriented such that an emitted light beam travels through the elongated coil coupled to the light emitting device. In preferred embodiments, the speaker system has a housing with an outlet that is transparent to sound waves and to electromagnetic radiation. It is contemplated that the light beam travels through the elongated coil before passing through such an outlet. In especially preferred embodiments, the outlet is an opening in the housing (such as an aperture or through-hole).

In preferred embodiments, the contemplated speaker systems have an elongated coil coupled to the speaker, and a second elongated coil coupled to a light emitting device. The speaker system can be any size and designed to use in any environment. Contemplated speaker systems include an earbud, an earphone, stereo system in a car, a home, a movie theater, etc. The speaker system can be connected to an audio output through a wire or by a wireless system (e.g., WiFi, Bluetooth™).

Inventors have found that scalar coils can modify the sound signature of audio feed through the scalar coil, for example by removing high-frequency audio artifacts typical of decompressed digital sound signals. Without wishing to be bound by theory, the Inventors believe that this reduction in digital noise is accomplished by reflection of electromagnetic forces back against themselves in the scalar coil assembly, which in turn causes the energy of the higher frequency components (e.g., ultrasonic) to cancel each other out. The measured benefit is that this scalar coil tends to reduce high frequency edging associated with digital processing (such as decompression) of audio signals (e.g., MP3 files, Bluetooth audio signals, etc.). This benefit is accomplished by inserting a scalar coil in the sound path of the loudspeakers being connected to the voice coils/armatures coils of the various drivers. It is contemplated that scalar coils can passively alter an audio signal to remove high frequencies associated with digital sound signals. This is especially advantageous in removing unwanted noises from audio sources, including, for example, static and sibilance.

Scalar coils also produce electromagnetic forces that influence animal physiology by stimulating the vagus nervous system to improve perceived audio quality when exposed to laser light and a photonic boom that accompanies passage through a device as described above. In some embodiments, the scalar coils can be mounted to guide the energy of a laser beam through the coil assembly producing a photonic reaction with the coil creating a dispersion of the energy to the wearer of the earbud to cause subliminal perception (e.g., low order stimulus to the nervous system.). When combined with a laser, the audio quality benefits of using a scalar coil can be enhanced by generating a photonic boom, which the Inventors believe can directly and/or indirectly interact with human cells to improve perceived audio quality. Additionally, when a laser passes through the scalar coil along the axis, the deflection of the photons by the scalar coil causes changes in the electromagnetic field near a user associated with the audio, thereby further improving perceived audio quality. However, it is contemplated that the laser can pass through the scalar coil at any angle that can change the actual audio quality and/or the perceived audio quality to a user.

Various objects, features, aspects and advantages of the inventive subject matter will become more apparent from the following detailed description of preferred embodiments, along with the accompanying drawing figures in which like numerals represent like components.

DETAILED DESCRIPTION

Figure 1A:
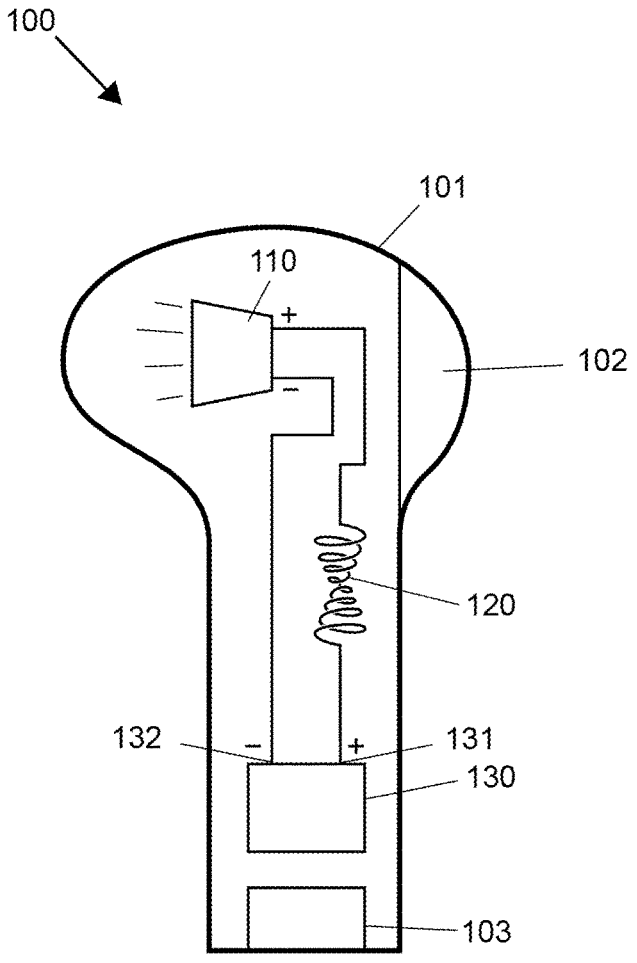
FIG. 1A shows an embodiment of a speaker system having a shape of an earbud, where a scalar coil is in series with the speaker.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

The recitation of ranges of values herein is merely intended to serve as a shorthand method of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Earbuds

An earbud of the inventive concept can include a housing or body that is in contact with and/or at least partially inserted into an ear of a user when in use. Such a housing can be constructed of one or more materials suitable for contact with human skin, and can have different compositions in different regions of the housing. For example, portions of the housing that are exposed when in use can be constructed of one or more rigid materials (e.g. hard plastic, metal, ceramic, etc.) whereas portions that are inserted into the ear canal can be constructed of one or more pliant materials (e.g. silicone rubber, latex, polyurethane, etc.). In some embodiments an earbud of the inventive concept can include a hook or similar projection that engages with the concha of the ear, improving stability and proper positioning of the earbud. The housing of the earbud can also support one or more control features that can be used to control earbud functions. In a preferred embodiment a portion of the body or housing can extend downwards in a stem or stalk.

Such an earbud can include a power supply (such as a battery) and one or more speakers, and is in communication with a source of audio and/or video files for playback through the earbud. Such audio and/or video files can be stored on memory within the earbud, or can be stored on memory in an external device (such as a computer, telephone, or portable audio player). In embodiments where audio and/or video files are stored in an external device the earbud can include an antenna, circuitry, and appropriate processing to support wireless communication (e.g. BlueTooth, WiFi, etc.). Alternatively or in addition to such wireless circuitry, and earbud of the inventive concept can include a port that supports a wired connection. Earbuds of the inventive concept can also include an antenna and associated circuitry to support wireless charging of an onboard power supply, for example by magnetic induction.

In FIG. 1A, the speaker system 100 has a shape of an earbud and has a speaker 110, a scalar coil 120, and a sound chip 130. The scalar coil 120 is coupled to and in series with the speaker 110 and the sound chip 130. The scalar coil 120 (an enlarged view shown in FIG. 1B) is a single strand of wire having two separate spiral windings that each winds in a continuous and gradually widening curve, about a center axis 120A so as to form a cone. The first spiral winding (on the top) has four turns 121-124, and the second spiral winding (on the bottom) also has four turns 126-129. The two spiral windings are connected at a center 125 and are symmetrical to each other with respect to the center 125. It is contemplated that in other embodiments, the spiral windings could have more turns, or fewer turns.

Figure 1B:
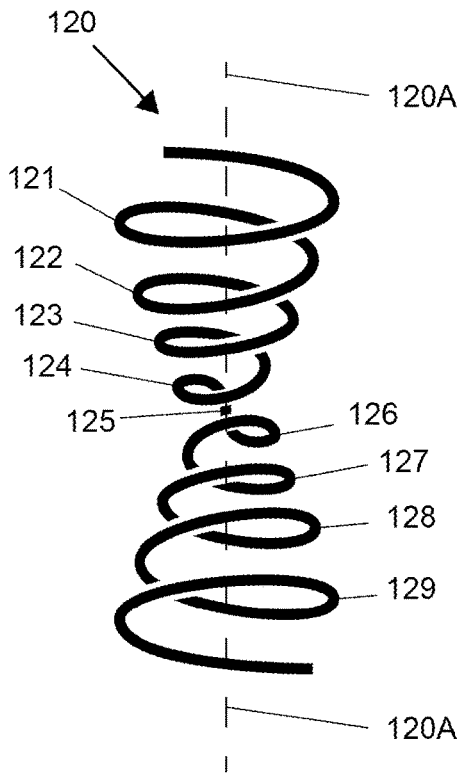
FIG. 1B shows a preferred embodiment of a scalar coil in FIG. 1A.

As shown in FIG. 1B, the second segment (126-129) of scalar coil 120 winds in an opposite direction to the first segment (121-124), when viewed from the wider end 121 of the first segment (i.e., from the top). In other words, the top spiral (126-129) winding winds in a clockwise direction, when viewed from its wider end near 121 (i.e., from the top). The bottom spiral winding (126-129) winds in a counter-clockwise direction, when viewed from wider end near 121 of the top spiral winding (i.e., from the top). Contemplated scalar coils can be flattened pancake coils (i.e., two dimensional) but can also be stretched into an elongated form (i.e., three dimensional).

Preferably, the scalar coil 120 is connected to the positive terminal of the speaker 110 and the sound chip 130. The sound chip 130 is an integrated circuit (i.e. "IC") designed to produce a sound signal. It can do so through digital, analog or mixed-mode electronics. Contemplated sound chips could contain oscillators, envelope controllers, samplers, filters and amplifiers. The sound chip 130 has a sound output. The positive terminal 131 of the output is in series with the scalar coil 120, and the negative terminal 132 is in series with the speaker 110. It is contemplated that the speaker system 100 has a control panel 102 (e.g., electronic deck) and a multi-functional switch 103 that can be used by a user to exercise control over the speaker 110.

Figure 2:
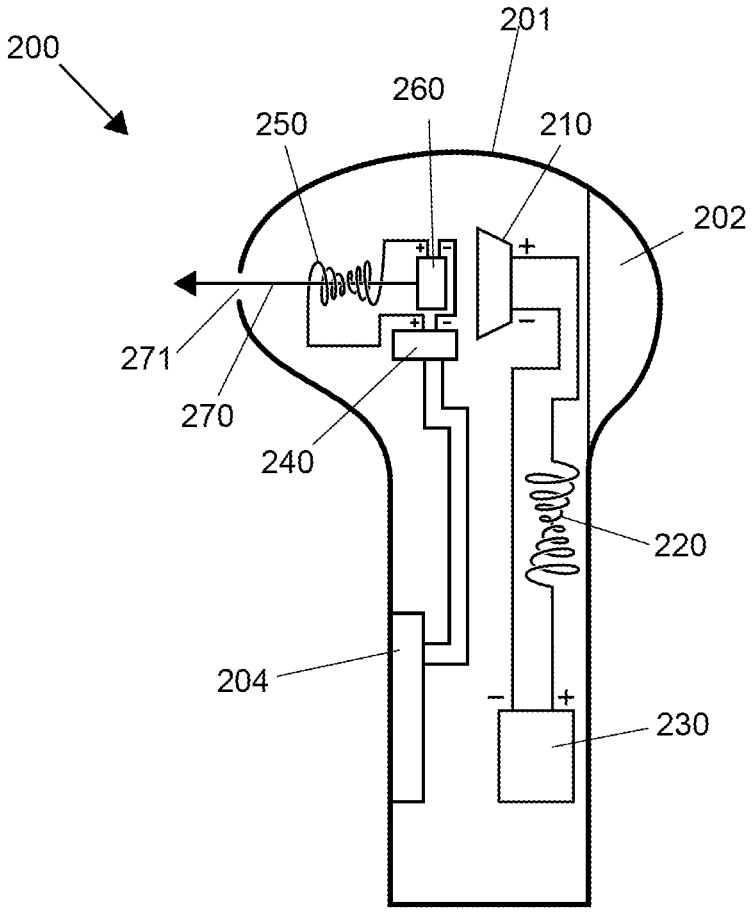
FIG. 2 shows a preferred embodiment of a speaker system having speaker and a laser emitter, both coupled to a scalar coil.

FIG. 2 shows a preferred embodiment of a speaker system 200 having a speaker 210, a scalar coil 220 in series with the speaker 210, and a sound chip 130, a laser device (240 and 260), and a scalar coil 250 in series with the laser device. The laser device has a laser driver 240 and a laser emitter 260. The laser emitter 260 is positioned to produce a laser beam 270 that travels through the scalar coil 250. The speaker system 200 has a housing 201 with an outlet 271 that is transparent to sound waves and to electromagnetic radiation. After passing the scalar coil 250, the laser beam 270 travel towards the outlet 271 after passing the elongated scalar coil 250. The outlet 271 can be an opening in the housing 201. It is contemplated that, when the speaker system 200 is worn in a user's ear, the outlet 271 would be near the user's ear canal, so that the laser beam 270 would shine into the user's ear canal.

Preferably, the laser beam 270 passes through the scalar coil 250 winding passes through the center of the coil in an orthogonal configuration. In other words, the laser beam 270 passes through the scalar coil 250 along its axis (e.g., 120A in FIG. 1B). In preferred embodiments, the scalar coil 250 is wired in series to the laser emitter 260 at the positive terminal if it is DC driven. The scalar coil 250 can be wired in series to the laser emitter 260 at either the positive or negative terminal if it is AC driven. It is contemplated that the laser beam 270 can change its phase (e.g., by 180 degrees) or any phase shift compared to the audio driver or the other laser driver after it passes through the scalar coil 250. The laser driver 240 and emitter 260 can be configured to emit lasers of any wavelength, preferably with wavelengths between 645 nm and 655 nm.

The audio system in FIG. 2 is similar to the audio system in FIG. 1A. The audio signal output 230 is run through a separate coil 220 which can be wound in a near exact path to the laser coil 250, but maintains its own circuit. The audio coil 220 is in series with the positive output of the audio output to the speaker 210. The speaker 210, audio IC 230, laser driver 240, and laser emitter 260, are powered by a battery 204 that is in the housing 201 of the speaker system 200. It is also contemplated that an outside power source can be used to power the electronic equipment. Moreover, the audio system 200 can be controlled a control interface 202, for example, an electronic deck.

Figure 3:
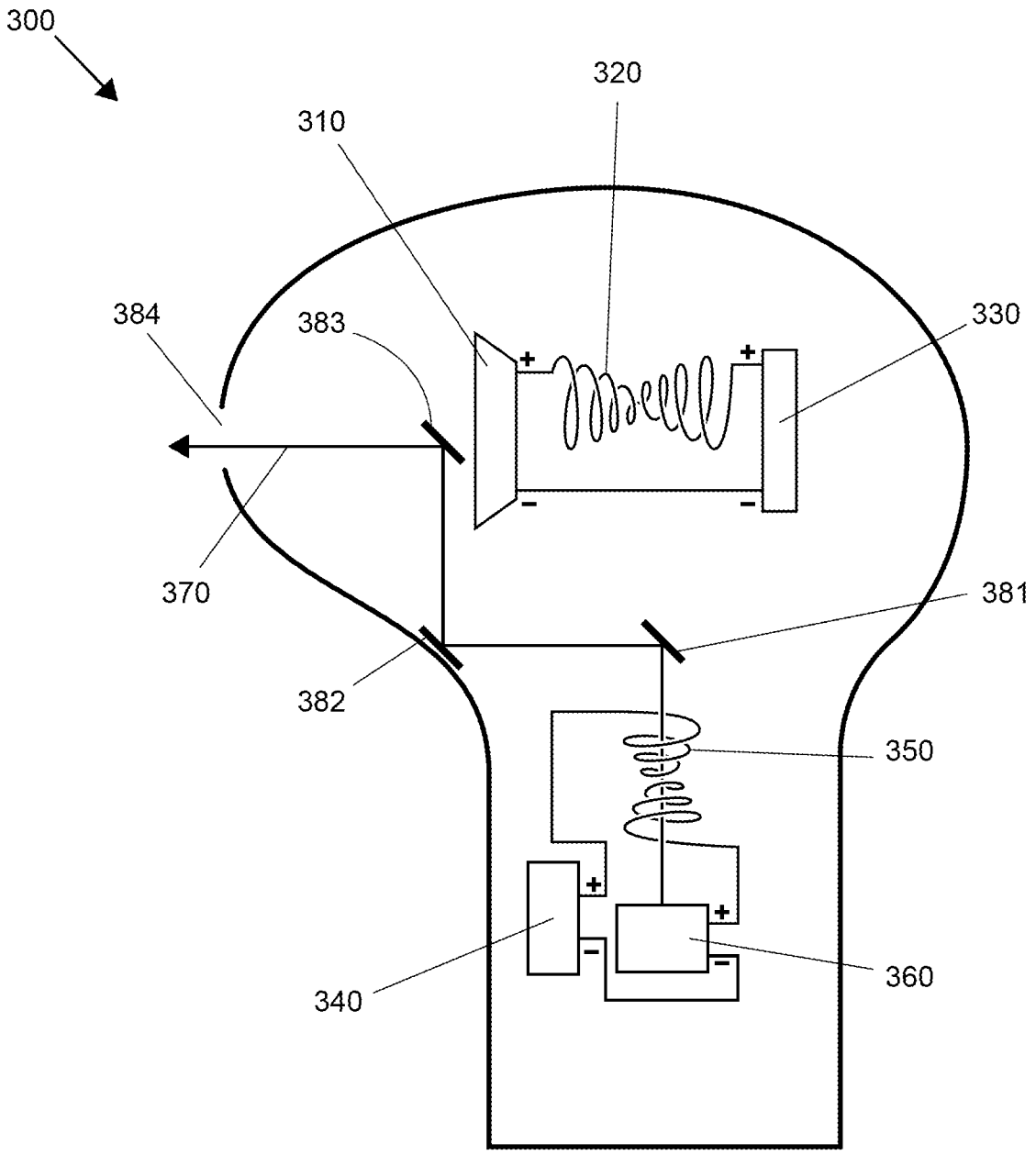
FIG. 3 shows another preferred embodiment of speaker system similar to that in FIG. 2, but the laser is now being guided by a set of reflectors.

The earbud in FIG. 3 is similar to the earbud in FIG. 2, but the positions of the laser system and audio systems are different. In FIG. 3, the laser beam 370 produced by the laser emitter 360 is guided with a set of reflectors 381-383 to reach the outlet 384. Contemplated reflectors can be a mirror or other reflective surfaces that can be used to change the course of the laser beam 370. It is also contemplated that the laser beam 370 can be guided by a waveguide, or travel inside a fiber-optic cable to reach the outlet 384.

In-Line Filters

Figure 4A:
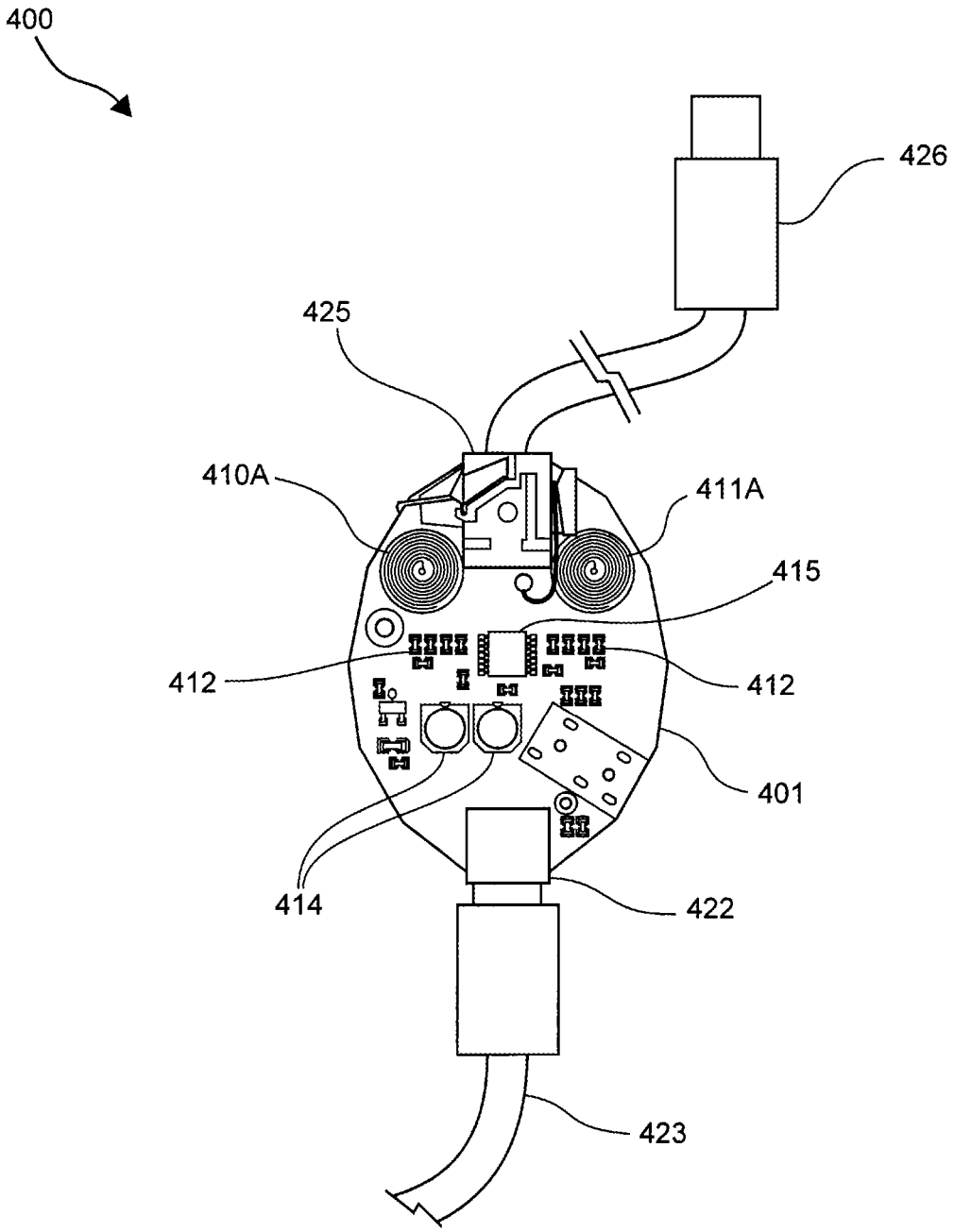
FIG. 4A is a schematic of a board and above-board components of an in-line filter using scalar coils, having digital input and analog output.
Figure 4B:
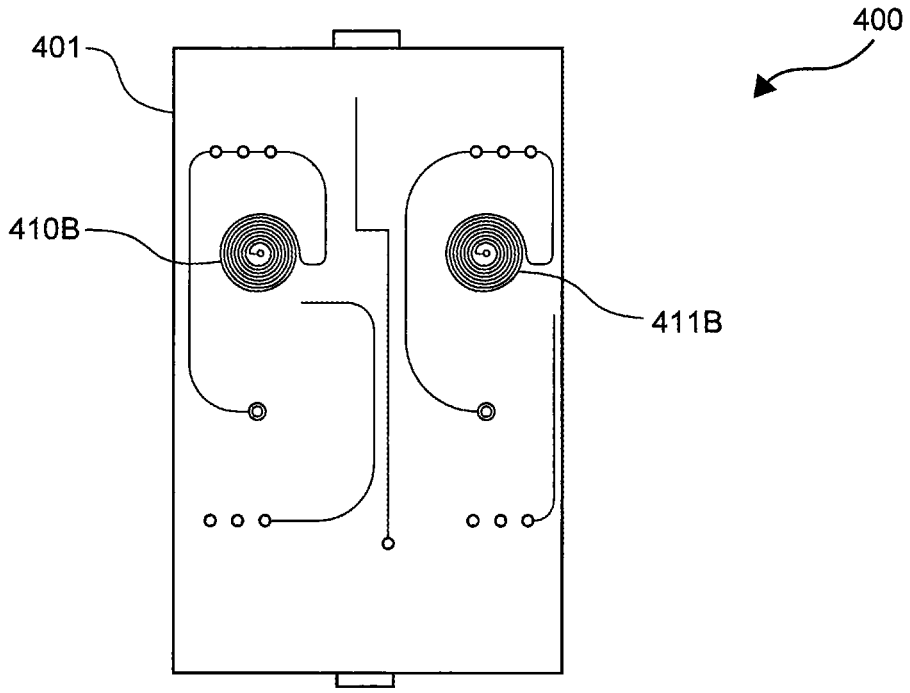
FIG. 4B is a schematic of below-board components of the in-line filter of FIG. 4A.
Figure 4C:
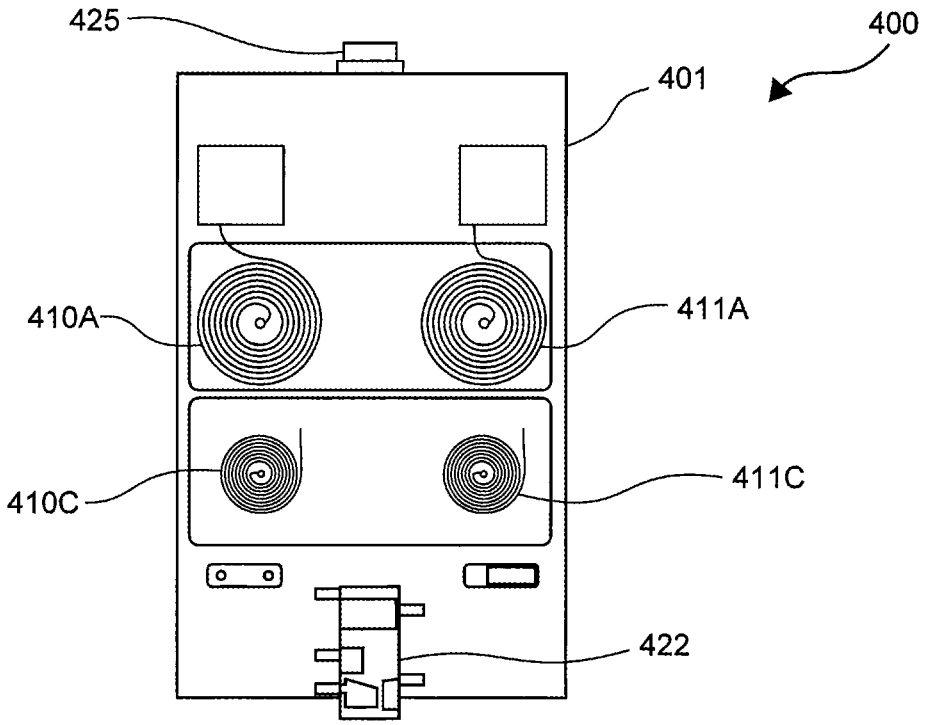
FIG. 4C is a schematic of an intermediate layer of components of the in-line filter of FIG. 4A.

FIGS. 4A, 4B and 4C schematically depict different layers of a board 40, and corresponding components of an in-line filter 400 using scalar coils. In general, digital signals arrive through cable 423 into coupling 422, are processed into analog signals at Digital to Analog Converter 415, are filtered using scalar-coupled coils 410A, 410B, and 410C for one channel, and scalar-coupled coils 411A, 411B, and 411C for a second channel. Other prominent components are resistors 412 and capacitors 414.

It should be appreciated that this same scalar coil filtering technology is not limited to input of audio signals, but could be applied to any arriving digital signals. And used in reverse, using a audio to digital converter, corresponding scalar coil technology could be used to filter and convert audio or other analog signals to digital signals. For example, in-line filter 400 could be used to record a digital copy of music or other audio signal.

Figure 5A:
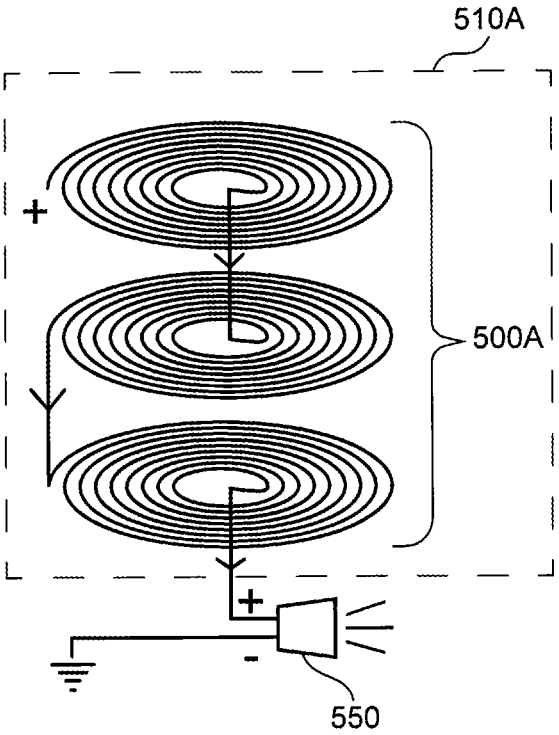
FIG. 5A is a schematic of an in-line filter having a stack of three scalar coils, positioned in parallel planes directly above one another.

FIG. 5A is a schematic of an in-line filter having a stack of three scalar coils, positioned in parallel planes directly above one another. It should be understood that the coils shown within FIG. 5A should be interpreted as being electrically coupled together as a set of scalar coils, and utilized as part of an in-line filter 510A, which would be similar to FIG. 4A, except that coils 410A and 410B would each be replaced by a set of coils 500A, with spiral windings with opposite winding directions, and coils 411A and 411B would each be replaced by a different sets of coils 500A, with spiral windings with opposite winding directions.

Figure 5B:
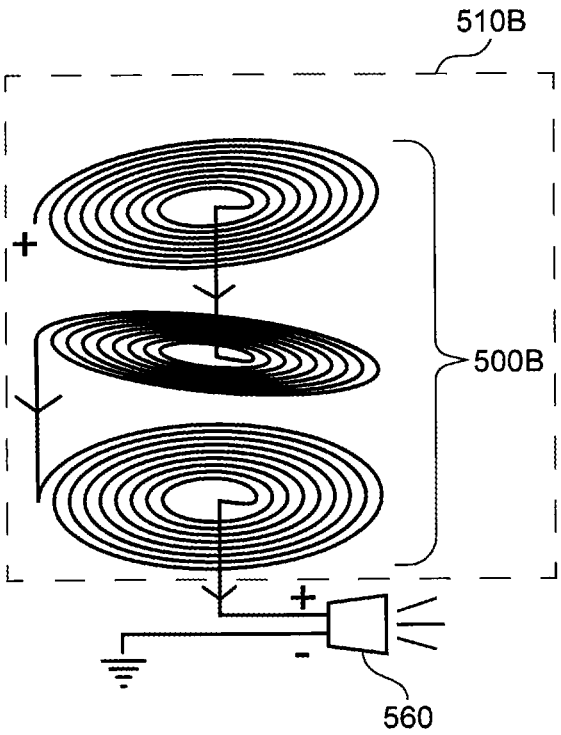
FIG. 5B is a schematic of an alternative in-line filter having stack of three scalar coils, positioned above one another, with one of the coils out of parallel with the other two.

FIG. 5B is a schematic of an alternative an in-line filter having stack of three scalar coils, positioned above one another, with one of the coils out of parallel with the other two. It should be understood that the coils shown within FIG. 5B should be interpreted as being electrically coupled together as a set of scalar coils, and utilized as part of an in-line filter 510B, which would be similar to FIG. 4A, except that coils 410A and 410B would each be replaced by set of coils 500B, with spiral windings with opposite winding directions, and coils 411A and 411B would each be replaced by a different set of coils 500B, with spiral windings with opposite winding directions.

Figure 6:
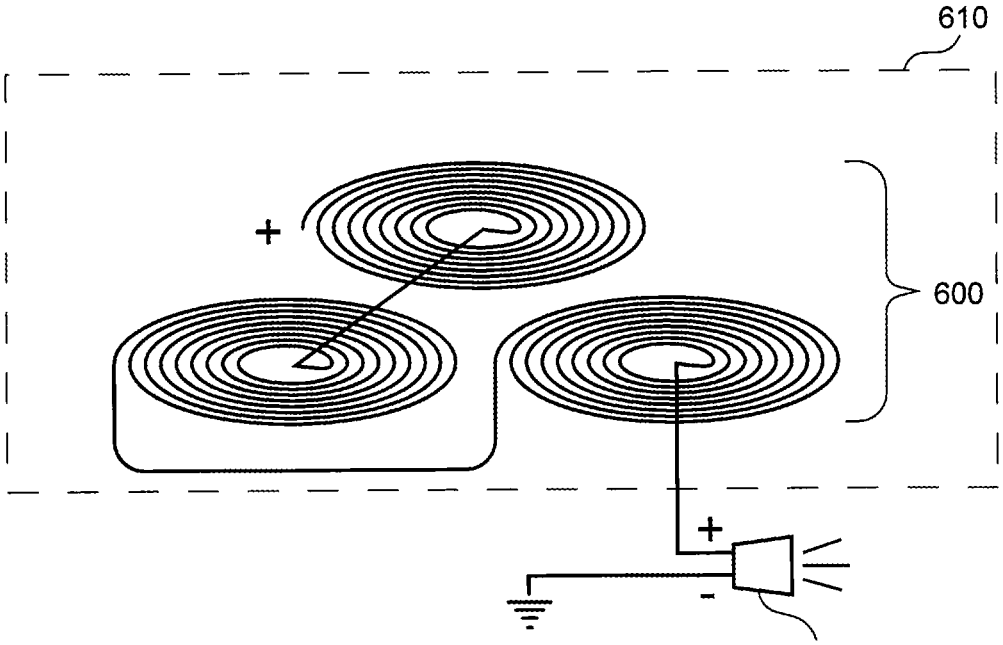
FIG. 6 is a schematic of an in-line filter having a stack of three scalar coils, two coplanar, and the third in a parallel plane, partially overlapping the other two.

FIG. 6 is a schematic of an in-line filter having a stack of three scalar coils, two coplanar, and the third in a parallel plane, partially overlapping the other two. It should be understood that the coils shown within FIG. 6 should be interpreted as being electrically coupled together as a set of scalar coils, and utilized as part of an in-line filter 610, which would be similar to FIG. 4A, except that coils 410A and 410B would each be replaced by a set of coils 600, with spiral windings with opposite winding directions and coils 411A and 411B would each be replaced by a different set of coils 600, with spiral windings with opposite winding directions.

Figure 7A:
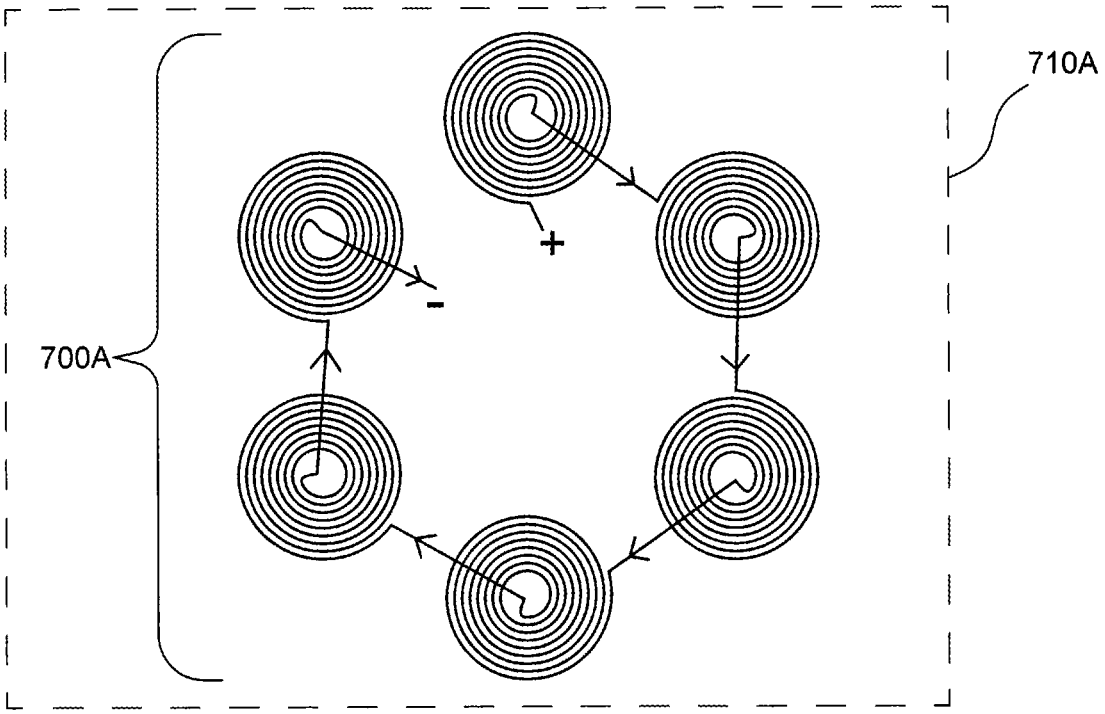
FIG. 7A is a schematic of an in-line filter having a set of six, coplanar scalar coils.

FIG. 7A is a schematic of an in-line filter having a set of six, coplanar scalar coils. It should be understood that the coils shown within FIG. 7A should be interpreted as being electrically coupled together as a set of scalar coils, and utilized as part of an in-line filter 710A, which would be similar to FIG. 4A, except that coils 410A and 410B would each be replaced by a set of coils 700A, with spiral windings with opposite winding directions, and coils 411A and 411B would each be replaced by a different set of coils 700A, with spiral windings with opposite winding directions.

Figure 7B:
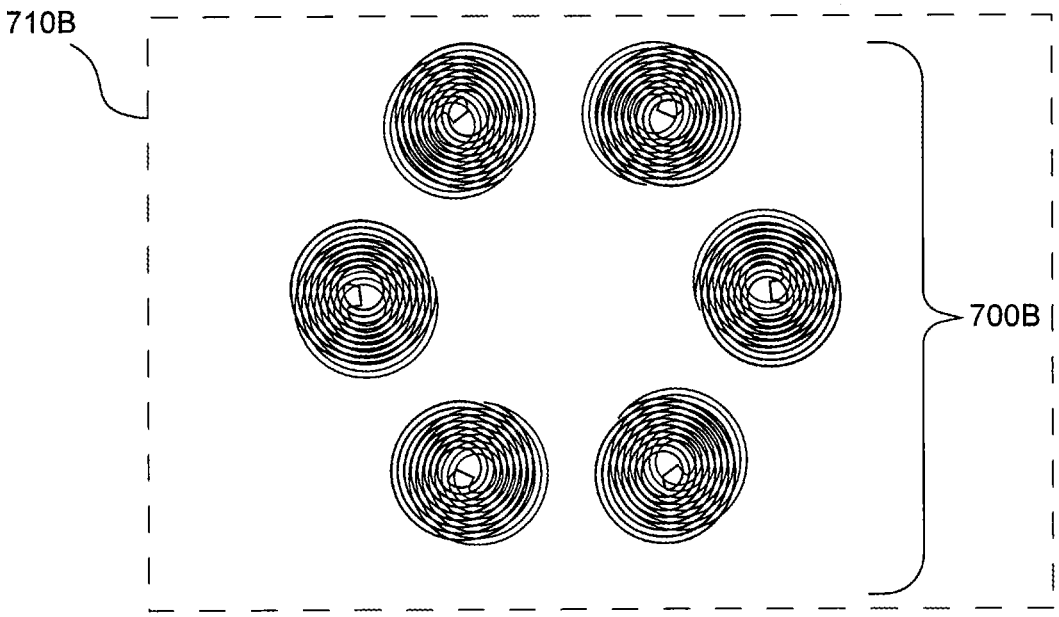
FIG. 7B is a schematic of an in-line filter having a twelve scalar coils, with an upper set of six substantially coplanar coils, positioned directly or almost directly above a lower set of six substantially coplanar coils.

FIG. 7B is a schematic of an in-line filter having a twelve scalar coils, with an upper set of six substantially coplanar coils, positioned directly or almost directly above a lower set of six substantially coplanar coils. It should be understood that the coils shown within FIG. 7B should be interpreted as being electrically coupled together as a set of scalar coils, and utilized as part of an in-line filter 710B, which would be similar to FIG. 4A, except that coils 410A and 410B would each be replaced by a set of coils 700B, with spiral windings with opposite winding directions, and coils 411A and 411B would each be replaced by a different set of coils 700B.

Figure 8:
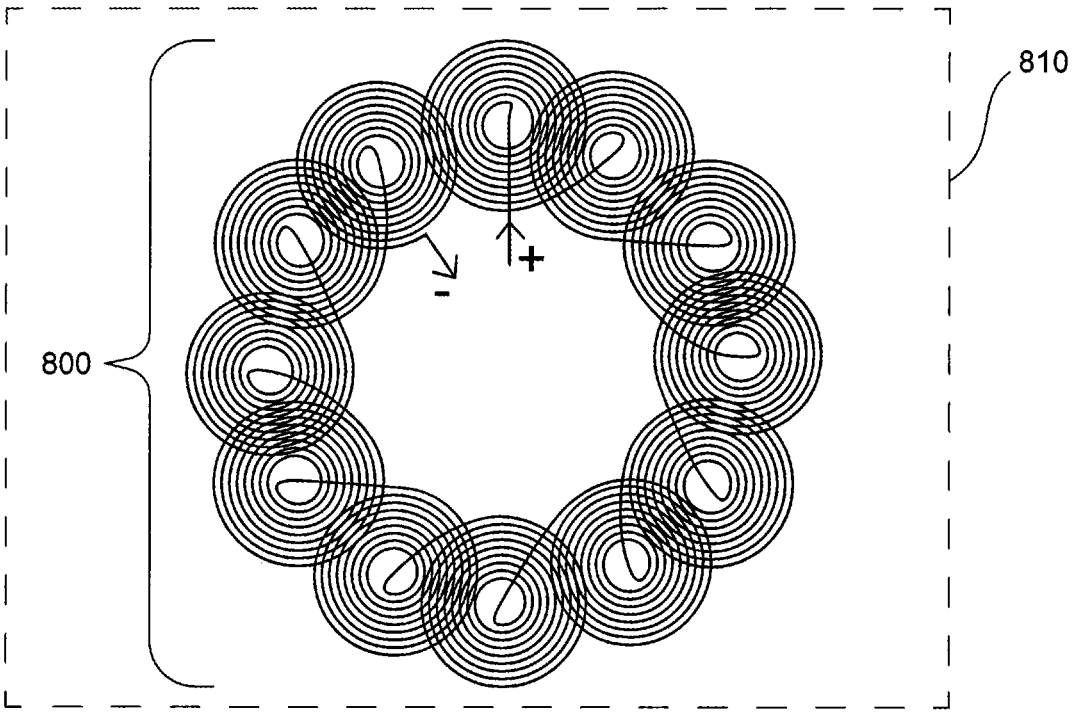
FIG. 8 is a schematic of an in-line filter having an alternative arrangement of twelve scalar coils, in which an upper set of six coplanar coils is arranged to partially overlap a lower set of six coplanar coils.

FIG. 8 is a schematic of an in-line filter having an alternative arrangement of twelve scalar coils, in which an upper set of six coplanar coils is arranged to partially overlap a lower set of six coplanar coils. It should be understood that the coils shown within FIG. 8 should be interpreted as being electrically coupled together as a set of scalar coils, and utilized as part of an in-line filter 810, which would be similar to FIG. 4A, except that coils 410A and 410B would each be replaced by a set of coils 800, and coils 411A and 411B would each be replaced by a different set of coils 800.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. An in-line filter comprising:

an input connector and an output connector;

a first circuit configured to receive a first signal via the input connector, and process the first signal through first and second scalar coils that are at least one of stacked and coplanar, and send the processed first signal via the output connector; and wherein the first and second coils are coplanar in a first plane, and further comprising third and fourth scalar coils that are coplanar in a second plane, the third coil at least partially overlapping the first coil, and the fourth coil at least partially overlapping the second coil.

2. The in-line filter of claim 1, wherein the first and second coils are completely overlapping.

3. The in-line filter of claim 1, wherein the first and second coils are positioned in parallel planes.

4. The in-line filter of claim 1, wherein the first coil is positioned in a plane out of parallel with the second coil.

5. The in-line filter of claim 1, further comprising a third scalar coil that is at least partially overlapping with at least one of the first and second coils.

6. The in-line filter of claim 5, wherein the first, second, and third coils are positioned in parallel planes.

7. The in-line filter of claim 5, wherein at least one of the first and second coils is positioned out of parallel with the third coil.

8. The in-line filter of claim 5, wherein at the first and second coils are coplanar, and the third coil is not coplanar with the first and second coils.

9. The in-line filter of claim 1, wherein the first and second coils are part of a first loop of coils, and further comprising at least third and fourth scalar coils that are coplanar in a second loop of coils, and each the coils of the first loop is overlapped by at least one of the coils of the second loop.

10. The in-line filter of claim 1, wherein the first and second coils are part of a first loop of coils, and further comprising at least third and fourth scalar coils that are coplanar in a second loop of coils, and each the coils of the first loop is overlapped by at least two of the coils of the second loop.

11. The in-line filter of claim 1, further comprising a Digital to Analog Converter (DAC) configured to convert the first signal received from the input connector from a digital format to an analog format.

12. The in-line filter of claim 1, further comprising a second circuit configured to receive a second signal via the input connector, and process the second signal in parallel to the first signal, through third and fourth coils that are either stacked or coplanar, and send the processed second signal via the output connector.

* * * * *